US008837925B2

(12) United States Patent
Lee et al.

(10) Patent No.: US 8,837,925 B2
(45) Date of Patent: Sep. 16, 2014

(54) REFRIGERANT HEATING APPARATUS AND METHOD FOR MANUFACTURING THE SAME

(75) Inventors: Sanghun Lee, Changwon (KR); Beomsoo Seo, Changwon (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 12/992,431

(22) PCT Filed: May 4, 2009

(86) PCT No.: PCT/KR2009/002357

§ 371 (c)(1),
(2), (4) Date: Nov. 12, 2010

(87) PCT Pub. No.: WO2010/128694

PCT Pub. Date: Nov. 11, 2010

(65) Prior Publication Data

US 2011/0069942 A1 Mar. 24, 2011

(30) Foreign Application Priority Data

May 4, 2009 (KR) ..... 10-2009-0038884

(51) Int. Cl.

| | |
|---|---|
| ***F24H 1/14*** | (2006.01) |
| ***H05B 3/56*** | (2006.01) |
| ***H05B 3/14*** | (2006.01) |

(52) U.S. Cl.

CPC ..... *H05B 3/145* (2013.01); *H05B 2214/04* (2013.01); *F25B 2400/01* (2013.01); *H05B 3/565* (2013.01); *F24H 1/142* (2013.01); *F24H 2250/10* (2013.01)

USPC ..... 392/480; 392/465; 392/468; 392/473; 392/478; 392/482; 29/428

(58) Field of Classification Search

USPC ..... 392/465, 468, 469, 472, 473, 478, 392/479–484; 29/428

See application file for complete search history.

(56) References Cited

U.S. PATENT DOCUMENTS

| | | | |
|---|---|---|---|
| 2,274,839 | A | 3/1942 | Marick |
| 4,774,397 | A | 9/1988 | Grise |

(Continued)

FOREIGN PATENT DOCUMENTS

| | | |
|---|---|---|
| JP | 01-302078 | 12/1989 |
| JP | 2002-005539 | 1/2002 |

(Continued)

OTHER PUBLICATIONS

Yeo-Hwan Yoon, "Transparent Film Heater Using Single-Walled Carbon Nanotubes", Aug. 14, 2007, Advanced Materials, Wiley InterScience, pp. 4284-4287.*

(Continued)

*Primary Examiner* — Dana Ross
*Assistant Examiner* — James Sims, III
(74) *Attorney, Agent, or Firm* — McKenna Long & Aldridge LLP

(57) ABSTRACT

A refrigerant heating apparatus is provided. The refrigerant heating apparatus includes a refrigerant pipe in which a refrigerant flows and a heating unit that is provided on an outer surface of the refrigerant pipe. The heating unit includes a plurality of electrodes that are provided at an outer surface of the refrigerant pipe and are spaced from each other and a plurality of carbon nanotube heating elements that are electrically connected to the plurality of electrodes. The plurality of carbon nanotube heating elements are heated by an applied power, and are disposed to be spaced from each other.

12 Claims, 2 Drawing Sheets

(56) References Cited

U.S. PATENT DOCUMENTS

| | | | | |
|---|---|---|---|---|
| 5,352,870 | A | 10/1994 | Daugherty et al. | |
| 6,229,123 | B1 | 5/2001 | Kochman et al. | |
| 6,580,061 | B2 * | 6/2003 | Black | 219/543 |
| 2005/0011572 | A1 | 1/2005 | Belcher | |
| 2005/0067406 | A1 | 3/2005 | Rajarajan et al. | |
| 2005/0207742 | A1 * | 9/2005 | Huang et al. | 392/478 |
| 2006/0088302 | A1 * | 4/2006 | Sturm | 392/480 |
| 2006/0272340 | A1 | 12/2006 | Petrenko | |
| 2007/0045275 | A1 * | 3/2007 | Steinhauser et al. | 219/228 |
| 2008/0016896 | A1 | 1/2008 | Rasch et al. | |

FOREIGN PATENT DOCUMENTS

| | | |
|---|---|---|
| WO | WO 2005-040066 | 5/2005 |
| WO | WO 2007/089118 A1 | 8/2007 |

OTHER PUBLICATIONS

International Search Report issued in PCT/KR2009/002357 dated May 26, 2010.

* cited by examiner

REFRIGERANT HEATING APPARATUS AND METHOD FOR MANUFACTURING THE SAME

TECHNICAL FIELD

The embodiment relates to a refrigerant heating apparatus and a method for manufacturing the same.

BACKGROUND ART

A refrigerant heating apparatus means a device that heats a refrigerant flowing in an apparatus. The refrigerant heating apparatus can be applied to all the products using a refrigerant. As one example, the refrigerant heating apparatus may be applied to an air conditioner.

DISCLOSURE

Technical Problem

An object of the embodiment provides a refrigerant heating apparatus using a carbon nanotube heating element as a heating source for heating a refrigerant and a method for manufacturing the same.

Technical Solution

In one aspect, a refrigerant heating apparatus includes: a refrigerant pipe in which a refrigerant flows; and a heating unit that is provided on an outer surface of the refrigerant pipe, wherein the heating unit includes: a plurality of electrodes that are provided at an outer surface of the refrigerant pipe and are spaced from each other; and a plurality of carbon nanotube heating elements that are electrically connected to the plurality of electrodes, are heated by an applied power, and are disposed to be spaced from each other.

In another aspect, a method for manufacturing a refrigerant heating apparatus includes: fixing a plurality of electrodes to a refrigerant pipe; fixing a plurality of carbon nanotube heating elements to an outer surface of the refrigerant pipe and connecting the carbon nanotube heating elements to the plurality of electrodes; and connecting a power connection part to the electrodes.

In yet another aspect, a method for manufacturing a refrigerant heating apparatus includes: forming a plurality of electrodes and a heating unit that includes a plurality of carbon nanotube heating element connected to the plurality of electrodes; fixing the heating unit to a refrigerant pipe in which a refrigerant flows; and connecting a power connection part to the electrodes.

Advantageous Effects

With the proposed embodiments, as the CNT heating element is used as the heating source for heating the refrigerant, the size and manufacturing cost of the heating unit can be reduced and the size of the air conditioner can thus be reduced.

Moreover, the carbon nanotube is coated on a heated body, such that it is possible to form the CNT heating element on the heated body having various shapes.

Also, as the plurality of CNT heating elements are disposed to be spaced from each other, even when any one CNT heating element is damaged, the refrigerant can be continuously heated.

MODE FOR INVENTION

Hereinafter, embodiments will be described in detail with reference to the accompanying drawings.

Figure 1:
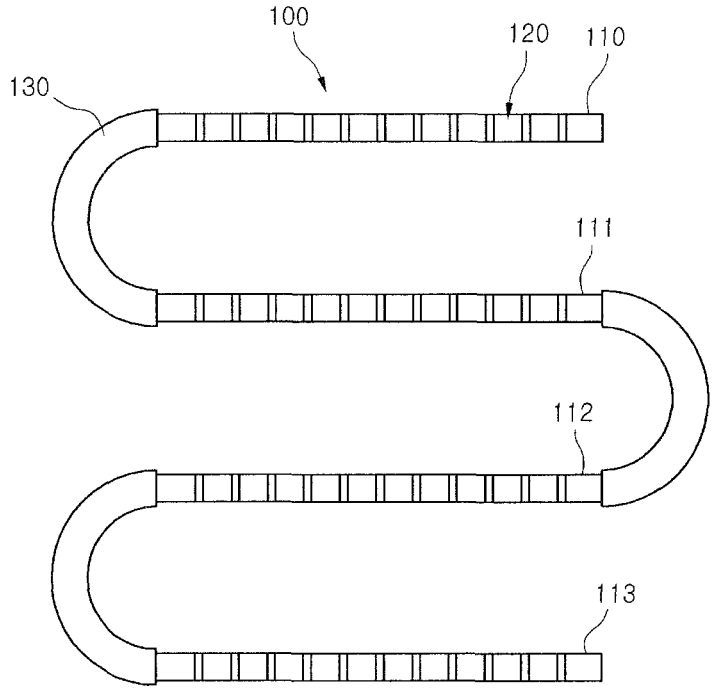
FIG. 1 is a diagram showing a refrigerant heating apparatus according to a first embodiment.

FIG. 1 is a diagram showing a refrigerant heating apparatus according to an embodiment of the present invention.

Referring to FIG. 1, a refrigerant heating apparatus 100 according to the embodiment includes a plurality of refrigerant pipes 110, 111, 112, and 113 in which a refrigerant flows and a connection pipe 130 that connects adjacent refrigerant pipes.

In detail, the cross section of the plurality of refrigerant pipes 110, 111, 112, and 113 may be formed in a circular shape by way of example and are not limited thereto.

The plurality of refrigerant pipes 110, 111, 112, and 113 may include, for example, a first refrigerant pipe to a fourth refrigerant pipe. In the embodiment, the number of refrigerant pipes is not limited. However, FIG. 1 is shown as including four refrigerant pipes by way of example.

The refrigerant may be input in one end of the first refrigerant pipe 110. The refrigerant may be discharged from one end of the fourth refrigerant pipe 113. The connection pipe 130 is bent and is formed in an approximate "U" shape. Two adjacent refrigerant pipes may be bonded to the connection pipe 130 by, for example, welding.

The outer sides of each refrigerant pipes 110, 111, 112, and 113 are provided with heating units 120 for heating the refrigerant that moves each refrigerant pipe.

Figure 2:
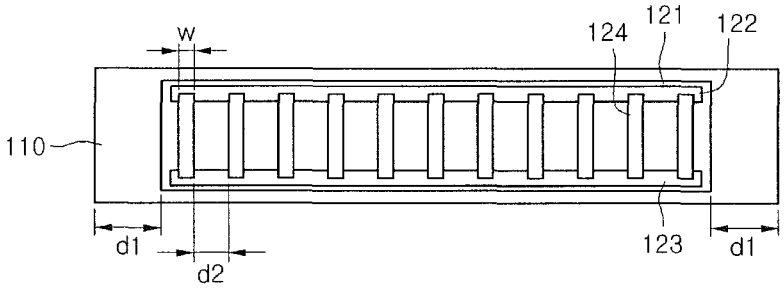
FIG. 2 is a development diagram of one refrigerant pipe according to the first embodiment.
Figure 3:
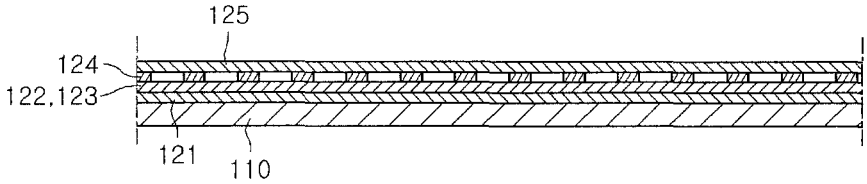
FIG. 3 is a cross-sectional view showing a structure of a heating unit according to the first embodiment.
Figure 4:
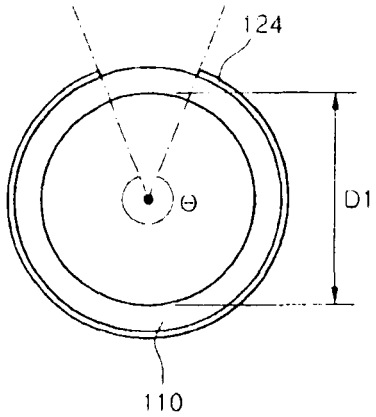
FIG. 4 is a diagram schematically showing a side view of the refrigerant pipe according to the first embodiment.

FIG. 2 is a development view of one refrigerant pipe according to the first embodiment, FIG. 3 is a cross-sectional view showing a structure of the heating unit according to the first embodiment, and FIG. 4 is a diagram schematically showing a side view of one refrigerant pipe according to the first embodiment.

Referring to FIGS. 2 to 5, the heating units 120 are fixed to outer surfaces of each refrigerant pipe 110, 111, 112, and 113. The heating units fixed to each refrigerant pipe have the same structure and therefore, the plurality of refrigerant pipes are collectively referred to reference numeral "110" The heating unit 120 includes an insulating sheet 121 that is fixed to the outer surface of the refrigerant pipe 110, a plurality of electrodes 122 and 123 that is fixed to the upper surface of the insulating sheet 121, a plurality of carbon nanotube heating elements 124 (hereinafter, referred to as 'CNT heating element') that are fixed to the upper surfaces of the pair of electrodes 122 and 123, and anti-oxidation layers 125 that are fixed to the upper surfaces of the plurality of CNT heating elements 124.

In detail, the insulating sheet 121 performs a role of easily fixing the CNT heating element 124 to the refrigerant pipe 110.

The pair of electrodes 122 and 123 is disposed in parallel in the state where they are spaced from each other. The pair of electrodes 122 and 123 is a part that supplies power to the plurality of CNT heating elements 124 and any one thereof corresponds to an anode an anode and the other corresponds to a cathode. Each electrode 122 and 123 is connected to an electric wire.

In the embodiment, the pair of electrodes 122 and 123 is lengthily extended along a length direction (direction in parallel with a center of the refrigerant pipe) of the refrigerant pipe 110. Therefore, the pair of electrodes 122 and 123 is spaced in a circumferential direction of the refrigerant pipe 110.

The plurality of CNT heating element 124 may complete in a rectangular shape but the shape thereof is not limited thereto. One end of each CNT heating element 124 contacts the upper surface of one electrode 122 and the other contacts the upper surface of another electrode 123.

The plurality of CNT heating elements 124 are disposed to be spaced by a predetermined interval d2 in a length direction of the refrigerant pipe 100. The refrigerant pipes 110, 111, 112, and 113 may be a copper pipe, an aluminum pipe, or a steel pipe.

The CNT heating element 124 indicates a heating element made of a carbon nanotube. The carbon nanotube means a material that hexagons formed of 6 carbons connects to each other to form a pipe shape.

In detail, the carbon nanotube is lightweight and has excellent electrical resistance. Further, the thermal conductivity of carbon nanotube is 1600 to 6000 W/mK, which is excellent as compared to the thermal conductivity of copper that is 400 W/mK. In addition, the electrical resistance of the carbon nanotube is $10^{-4}$ to $10^{-5}$ ohm/cm, which is similar to the electrical resistance of copper.

The embodiment uses the properties of the carbon nanotube that is used as a heating source for heating a refrigerant.

After the carbon nanotube is fixed (for example, coated) on the insulating sheet 121, current is applied to the pair of electrodes 122 and 123 such that the carbon nanotube is heated. In the embodiment, the state where the carbon nanotube is coated on the insulating sheet 121 may be referred to the CNT heating element 124.

When the CNT heating element 124 is applied as the heating source of the refrigerant, the CNT heating element 124 can be semi-permanently used and the shape processing thereof can be easily performed, such that the CNT heating element 124 can be applied to the refrigerant pipe. In addition, when the CNT heating element 124 is applied as the heating source of the refrigerant, the volume of the heating unit can be reduced and the refrigerant can be heated early.

In other words, when the CNT heating element uses a positive temperature coefficient (PTC) element, a sheathe heater, etc., as the heating source, the volume thereof can be greatly reduced and the cost for generating power as much as 1 kw can be reduced.

Moreover, as the plurality of CNT heating elements 124 are disposed around the refrigerant pipe 110, even when any one CNT heating element is damaged, the refrigerant pipe can be continuously heated.

Meanwhile, the width w of the CNT heating element 124 is formed to be equal to or larger than an interval d2 between the adjacent CNT heating elements 124. In the embodiment, when the lengths of the length and breadth of the CNT heating element are not equal to each other, the length of the short side may be defined as a width and when the lengths of the length and breadth of the CNT heating element are equal to each other, a length of any one side may be defined as a width.

In detail, since the CNT heating element 124 has a large electrical resistance, the heat value becomes large despite a narrow contact area (a contact area of the CNT heating element and the refrigerant pipe).

In the state where the heat capacity of the heating unit of the refrigerant pipe 110 is maintained constantly (for example, 4 kw per one refrigerant pipe), since a case where the interval between the CNT heating elements 124 is narrower than a case where the interval between the CNT heating elements 124 is large, the refrigerant is heated only in some areas of the refrigerant pipe 110 (may be referred to local heating), such that there is a problem in that the boiling of the refrigerant occurs.

Therefore, in order to prevent the boiling of the refrigerant due to the local heating, in the embodiment, the width w of the CNT heating element 124 is formed to be equal to or smaller than the interval d2 between the adjacent CNT heating elements. FIG. 2 shows that the interval d2 between the CNT heating elements is, for example, larger than the width w of the CNT heating element 124.

In addition, whether or not the boiling of the refrigerant is related to the contact area between the CNT heating element 124 and the refrigerant pipe 110. When intending to form the heating unit 120 in the same capacity, if the contact area of the CNT heating element 124 and the refrigerant pipe 110 is increased, the thickness of the CNT heating element 124 is reduced. On the other hand, when the thickness of the CNT heating element 124 is increased, the contact are of the CNT heating element 124 and the refrigerant pipe 110 is reduced.

When comparing the above-mentioned two cases, as the thickness of the CNT heating element is large and the contact area of the CNT heating element and the refrigerant pipe can be reduced, the surface temperature of the CNT heating element is large and the heat concentration phenomenon is large, such that the boiling phenomenon of the refrigerant may occur and the bending phenomenon of the refrigerant pipe may occur.

Therefore, it is preferable that the contact area of the CNT heating element 124 and the refrigerant pipe 110 is increased. In other words, the length of the CNT heating element 124 surrounded along the circumference of the refrigerant pipe 110 (circumferential direction) is formed similar to the circumference of the refrigerant pipe. However, since the spaced distance between the pair of electrodes 122 and 123 is secured, an angle, which is formed by a line connecting the center of the refrigerant pipe 110 to one end of the CNT heating element 124 and a line connecting the center of the refrigerant pipe 110 to other end of the CNT heating element 124, has a smaller value than 355° when being viewed from FIG. 4.

The sum of the areas of the plurality of CNT heating elements is formed at 60% or less of an area calculated by a product of a distance between two CNT heating elements disposed at both ends of the plurality of CNT heating elements and a height of the CNT heating element (up and down length when being viewed from FIG. 2) by the spaced distance of the plurality of CNT heating elements and the angle of the CNT heating element formed in the circumferential direction of the refrigerant pipe.

In addition, whether or not the boiling of the refrigerant is related to the refrigerant amount that moves the inside of the refrigerant pipe. In detail, when the heat having the same capacity is applied to the refrigerant pipe, the case where the diameter of the refrigerant pipe is small has a higher possibility of the boiling than the case where the diameter thereof is large. In other words, a case where the refrigerant amount is small has a higher possibility of the boiling of refrigerant than the case where the refrigerant amount is small.

Therefore, in the embodiment, a diameter D1 of the refrigerant pipe is formed to be larger than 15.88 mm (or ⅝ inches). As one example, the diameter D1 of the refrigerant pipe may be formed at 25.44 mm (or 1 inch).

In addition, whether or not the boiling of the refrigerant is related to the thickness of the refrigerant pipe. The case where the thickness of the refrigerant pipe is thin has a higher possibility of the generation of boiling than the case where the thickness thereof is thick, since the time and amount that heat is transferred to the refrigerant in the inside the refrigerant pipe are large.

Therefore, in the embodiment, the thickness of the refrigerant pipe 110 may be formed at 2 mm or more.

Meanwhile, as described above, the two adjacent refrigerant pipes can be connected to each other by the connection part 130 and each refrigerant pipe and the connection part 130 are bonded to each other by welding. However, when the refrigerant pipe 120 and the connection part 130 are welded in the state where the heating unit 120 is fixed to the refrigerant pipe 120, the heating unit (in particular, electrode) may be damaged by welding heat. Therefore, in order to prevent the damage of the heating unit during the welding, the heating unit 120 may be disposed to be spaced by the predetermined interval d1 from each end of the refrigerant pipe. The predetermined interval d1 may be 50 mm or more.

Although the embodiment describes that two refrigerant pipes are connected by the connection part by way of example, one end of each refrigerant pipe can be connected to a first header and the other of each refrigerant pipe can be connected to a second header. In this case, the heating unit is disposed to be spaced by 50 mm or more from each end of the refrigerant pipes.

The structure that the plurality of refrigerant pipes are communicated with each other by the header is the same as the known structure and therefore, the detailed description therefore will be omitted.

Hereinafter, a method for manufacturing the refrigerant heating apparatus will be described.

First, a plurality of refrigerant pipes are prepared. Then, the refrigerant pipe is provided with the heating unit 120. In detail, the insulating sheet 121 is coated around the refrigerant pipe. Then, the pair of electrodes 122 and 123 is fixed to the upper surface of the insulating sheet 121. The matter that the pair of electrodes 122 and 123 is disposed to be spaced from each other is already described. Thereafter, the plurality of CNT heating elements 124 are disposed to be spaced by a predetermined interval on the upper surface of the electrode. Next, the anti-oxidation layer 125 is coated on the upper surface of the plurality of CNT heating elements 124. Finally, the power connection part (electric wire) 145, 146 is fixed to the pair of electrodes. When the connection part and the plurality of refrigerant pipes are connected with each other by the welding and finally, the refrigerant heating apparatus completes. Unlike this, the heating unit is manufactured by a separate article and the heating unit may be then fixed to the refrigerant pipe.

In detail, each of the refrigerant pipe 110 and the heating unit 120 is first prepared. The heating unit is a member that the insulating sheet, the pair of electrodes, the plurality CNT heating elements, and the anti-oxidation layer, which are already described, are sequentially formed.

Then, the heating unit 110 is fixed to the refrigerant pipe 110. Then, the connection part and the plurality of refrigerant pipes are connected to each other by the welding and thus, the refrigerant heating apparatus completes. Finally, the power connection part (electric wire) 145, 146 is fixed to the pair of electrodes. With the embodiment, since the heating unit manufactured by a separate article is fixed to the refrigerant pipe, the assembling time of the refrigerant heating apparatus is reduced and the assembling process is simplified.

Figure 5:
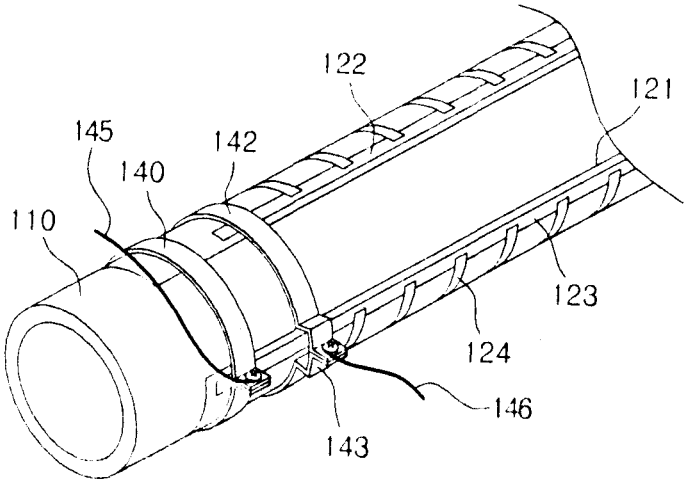
FIG. 5 is a perspective view showing a refrigerant pipe according to a second embodiment.

FIG. 5 is a perspective view showing a refrigerant pipe according to a second embodiment.

The configuration of the embodiment is the same as the configuration of the first embodiment but has a difference in the connection structure of the power connection part 145, 146 and the electrode. Therefore, only the feature parts of the embodiment will be described.

Referring to FIG. 5, the refrigerant pipe 110 of the present embodiment is provided with the heating unit as described above. The heating unit includes the pair of electrodes 122 and 123 and any one 122 (first electrode) of the pair of electrodes 122 and 123 is formed to be smaller than the length (length direction of the refrigerant pipe) of another electrode 123 (second electrode). In other words, the distance from the end of the refrigerant pipe 110 to the first electrode is larger than the distance to the second electrode 123. The pair of electrodes 122 and 123 and each power connection part (electric wire) 145, 146 can be electrically connected by the connection members 140 and 142. The connection members 140 and 142 may be formed of a conductive material. The connection members 140 and 142 includes a first connection member 140 that connects the second electrode 122 to the power connection part 145 and a second connection member 142 that connects the first electrode 123 to the power connection part 146. Each connection member 140 and 142 surrounds the entire refrigerant pipe.

The first connection member 140 contacts only the second electrode 123 in the state where the first connection member 140 surrounds the refrigerant pipe. Since the distance from the end of the refrigerant pipe 110 to the first electrode is larger than the distance to the second electrode 123, the second connection member 142 surrounds the refrigerant pipe so as to contact the first electrode, such that the second connection member 142 can contact the second electrode. Therefore, in the embodiment, in order to prevent the contact of the second connection member 142 and the second electrode 123, the second connection member 142 is provided with an interval forming part 143. With the embodiment, since each connection member 140 and 142 surrounds the upper surfaces of the electrodes 122 and 123 and the power connection part 145, 146 is connected to the connection members 140 and 142, the damage of the electrode due to heat generated during the welding bonding of the refrigerant pipe 110 and the connection part 130 can be prevented. In other words, the connection member performs a role of protecting the electrode from heat.

Figure 6:
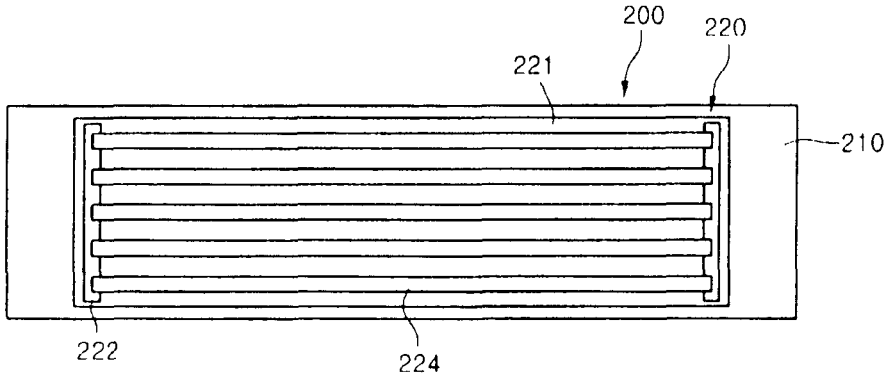
FIG. 6 is a development diagram of a refrigerant pipe according to a third embodiment.

FIG. 6 is a development diagram of a refrigerant pipe according to a third embodiment.

The configuration of the embodiment is the same as the configuration of the first embodiment but has a difference in the arrangement of the elements configuring the heating unit.

Referring to FIG. 6, a refrigerant heating apparatus 200 according to the present embodiment includes a refrigerant pipe 210 and a heating unit 220. The heating unit 220 includes an insulating sheet 211 that is fixed to the upper surface of the refrigerant pipe 210, a pair of electrodes 222 that are fixed to the upper surface of the insulating sheet 211 and is disposed along the circumference of the refrigerant pipe 200, and a plurality of CNT heating elements 224 having one end connected to one electrode and the other end connected to the other electrode.

The pair of electrodes 222 is disposed to be spaced from each other. The plurality of CNT heating elements 224 are disposed to be spaced from each other and is extended in a length direction of the refrigerant pipe 210.

Such a refrigerant heating apparatus can be applied to an air conditioner that is used in, for example, a place where an outdoor temperature is low or extremely low. In other words, in order to transfer the refrigerant having a required temperature to a compressor, the refrigerant heating apparatus may be provided on a pipe that bypasses the refrigerant discharged from a condenser to the compressor. Alternatively, the refrigerant heating apparatus may be provided on a pipe that connects an evaporator and the compressor.

The invention claimed is:

1. A refrigerant heating apparatus comprising:

a refrigerant pipe in which a refrigerant flows; and a heating unit that is provided on an outer surface of the refrigerant pipe, wherein the heating unit includes:

an insulating sheet on an outer surface of the refrigerant pipe;

a plurality of electrodes that are provided at an outer surface of the refrigerant pipe, the plurality of electrodes comprising a first electrode and a second electrode, wherein the second electrode is spaced apart from the first electrode, and the first and second electrode being extended in a length direction of the refrigerant pipe;

a plurality of carbon nanotube heating elements that are electrically connected to the plurality of electrodes to generate heat by an applied power, the plurality of electrodes being disposed to be spaced from each other; and a plurality of connection members that electrically connect a plurality of electric wires for supplying power to the plurality of electrodes, the connection members comprising a first connection member coupled to the second electrode and a second connection member surrounding the refrigerant pipe to make contact with the first electrode, wherein the first and second electrodes are between the insulating sheet and the carbon nanotube heating element, and the second connection member comprises a first part to make contact with the first electrode, a second part to be spaced apart from the second electrode and a pair of connectors extended from the first part in a radial direction of the refrigerant pipe to connect with both ends of the second part.

2. The refrigerant heating apparatus according to claim 1, wherein the plurality of carbon nanotube heating elements are disposed to be spaced from each other by a predetermined interval in a direction in parallel with the central line of the refrigerant pipe.

3. The refrigerant heating apparatus according to claim 2, wherein when each carbon nanotube heating element surrounds the refrigerant pipe in a circumferential direction of the refrigerant pipe, an angle formed by the carbon nanotube heating elements is 355° or less based on the center of the refrigerant pipe.

4. The refrigerant heating apparatus according to claim 1, wherein the upper surface of the plurality of carbon nanotube heating elements are coated with an anti-oxidation layer.

5. The refrigerant heating apparatus according to claim 1, wherein the plurality of carbon nanotube heating elements are arranged to be spaced from each other by a predetermined interval along the circumferential direction of the refrigerant pipe.

6. The refrigerant heating apparatus according to claim 1, wherein the heating unit is spaced by 50 mm or more from both ends of the refrigerant pipe.

7. The refrigerant heating apparatus according to claim 1, wherein the width (w) of each carbon nanotube heating element is equal to or smaller than an interval between the carbon nanotube heating elements.

8. The refrigerant heating apparatus according to claim 1, wherein the sum of the areas of the plurality of carbon nanotube heating elements is formed at 60% or less of an area calculated by a product of a distance between two carbon nanotube heating elements disposed at both ends of the plurality of carbon nanotube heating elements and a height of the carbon nanotube heating element.

9. The refrigerant heating apparatus according to claim 1, wherein a plurality of refrigerant pipes are disposed to be spaced from each other and the plurality of refrigerant pipes are connected to each other by a connection part.

10. A method for manufacturing a refrigerant heating apparatus comprising:

attaching an insulating sheet on an outer surface of a refrigerant pipe;

fixing a plurality of electrodes on the insulating sheet, the plurality of electrodes comprising a first electrode and a second electrode, wherein the second electrode is spaced apart from the first electrode;

fixing a plurality of carbon nanotube heating elements on the plurality of electrodes and connecting the carbon nanotube heating elements to the plurality of electrodes; and connecting a power connection part to the electrodes through a plurality of connection members, the connection members comprising a first connection member surrounding the refrigerant pipe to make contact with the second electrode and a second connection member coupled to the first electrode, wherein the first and second electrodes are between the insulating sheet and the carbon nanotube heating element, and the second connection member comprises a first part to make contact with the first electrode, a second part to be spaced apart from the second electrode and a pair of connectors extended from the first part in a radial direction of the refrigerant pipe to connect with both ends of the second part.

11. The method for manufacturing a refrigerant heating apparatus according to claim 10, further comprising forming an anti-oxidation layer on the upper surface of the plurality of carbon nanotube heating elements.

12. The method for manufacturing a refrigerant heating apparatus according to claim 10, wherein the plurality of carbon nanotube heating elements are disposed to be spaced from each other.

* * * * *